US008404321B2

(12) United States Patent
Tohmatsu et al.

(10) Patent No.: US 8,404,321 B2
(45) Date of Patent: Mar. 26, 2013

(54) THERMAL TRANSFER RECORDING MEDIUM

(75) Inventors: Hiroshi Tohmatsu, Shizuoka (JP); Kazuyoshi Inamura, Shizuoka (JP); Katsushi Shishido, Shizuoka (JP); Norihiro Ohtsuka, Shizuoka (JP); Toru Nagahashi, Yamaguchi (JP); Yoshiro Takesue, Yamaguchi (JP)

(73) Assignee: Ricoh Company, Ltd., Tokyo (JP)

( * ) Notice: Subject to any disclaimer, the term of this patent is extended or adjusted under 35 U.S.C. 154(b) by 295 days.

(21) Appl. No.: 12/785,828

(22) Filed: May 24, 2010

(65) Prior Publication Data

US 2010/0297369 A1 Nov. 25, 2010

(30) Foreign Application Priority Data

May 25, 2009 (JP) ..... 2009-125547

(51) Int. Cl.
*B41M 5/00* (2006.01)

(52) U.S. Cl. ..... 428/32.6; 428/32.81; 428/32.82; 428/32.83; 428/32.84; 428/32.87; 428/913

(58) Field of Classification Search ..... 428/32.6, 428/32.81, 32.82, 32.83, 32.84, 32.87, 913
See application file for complete search history.

(56) References Cited

U.S. PATENT DOCUMENTS

| | | | | |
|---|---|---|---|---|
| 4,963,522 | A * | 10/1990 | Egashira et al. | 503/227 |
| 5,081,100 | A * | 1/1992 | Matsushita et al. | 503/227 |
| 5,716,477 | A | 2/1998 | Yamaguchi et al. | |
| 5,773,153 | A | 6/1998 | Shiokawa et al. | |
| 5,879,790 | A * | 3/1999 | Sogabe et al. | 428/32.69 |
| 5,945,220 | A * | 8/1999 | Ide et al. | 428/32.6 |
| 5,952,103 | A | 9/1999 | Shiokawa et al. | |
| 6,117,562 | A | 9/2000 | Yamaguchi et al. | |
| 2001/0025687 | A1 * | 10/2001 | Cross | 156/240 |
| 2004/0142263 | A1 * | 7/2004 | Mikuriya et al. | 430/108.2 |
| 2005/0058927 | A1 * | 3/2005 | Mikuriya et al. | 430/110.2 |
| 2006/0165922 | A1 * | 7/2006 | Toyoda et al. | 428/32.84 |
| 2007/0120922 | A1 * | 5/2007 | Belelie et al. | 347/100 |
| 2007/0160923 | A1 * | 7/2007 | Matsumoto et al. | 430/108.1 |
| 2009/0208861 | A1 * | 8/2009 | Nakajima | 430/108.4 |

FOREIGN PATENT DOCUMENTS

| | | |
|---|---|---|
| JP | 6-293188 | 10/1994 |
| JP | 9-156240 | 6/1997 |
| JP | 2001-63229 | 3/2001 |
| JP | 3835956 | 8/2006 |

OTHER PUBLICATIONS

Jul. 5, 2010 European search report in connection with counterpart European patent application No. 10163541.

* cited by examiner

*Primary Examiner* — Betelhem Shewareged
(74) *Attorney, Agent, or Firm* — Cooper & Dunham LLP

(57) ABSTRACT

A thermal transfer recording medium including a support, a release layer and an ink layer, the release layer and the ink layer being disposed in this order over the support, wherein the ink layer contains carnauba wax, an organic fatty acid having an acid value of 90 to 200, and at least one of a long-chain alcohol represented by Formula (1) and a long-chain alcohol represented by Formula (2), Formula (1)

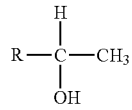

Formula (2)

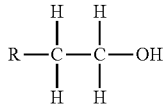

where R denotes a group containing 28 to 38 carbon atoms.

6 Claims, No Drawings

THERMAL TRANSFER RECORDING MEDIUM

BACKGROUND OF THE INVENTION

1. Field of the Invention

The present invention relates to a thermal transfer recording medium of thermal fusion type, capable of stably forming high-quality transferred images over a long period of time.

2. Description of the Related Art

In a thermal fusion type transfer recording method, a thermal transfer ink sheet (thermal transfer recording medium) is heated using thermal energy of a laser, a thermal head, etc. controlled with an electrical signal, and the fused ink is transferred onto a transfer target object to record an image.

Ink layers that are each composed mainly of wax as a thermally fusible material, as well as a colorant, are becoming popular as ink layers of thermal transfer recording media of this sort. For example, carnauba wax is favorably used.

The carnauba wax is advantageous in that it yields superior rub resistance (because it is a hard wax), superior sensitivity characteristics (because of its low melting point) and superior printing characteristics (because of its sharp heat-related changeability and low melt viscosity). For example, the carnauba wax is used for the purpose of forming transferred images superior in rub resistance and lubricity (refer to Japanese Patent Application Laid-Open (JP-A) Nos. 06-293188 and 09-156240).

Also, the carnauba wax has conventionally been made aqueous and used in the form of emulsion. In such cases, when the emulsion is heated with a thermal head, cutting and resultant separation preferentially take place at boundaries between particles forming the emulsion. The cut and separated pieces are transferred to the surface of a transfer target object. Therefore, edges of transferred matter (printed matter) are very sharp, and, due to the aqueousness of the emulsion, its environmental load can be reduced.

Here, when the aqueous emulsion of the carnauba wax is formed, an emulsifier is generally used. For example, an organic fatty acid is used as this emulsifier (refer to Japanese Patent (JP-B) No. 3835956). In a case where only an organic fatty acid is used as the emulsifier, the carnauba wax can be emulsified with ease. However, the following problem exists: despite the fact that the carnauba wax is first completely melted at the time of the formation of the aqueous emulsion, blooming of the carnauba wax occurs as time passes, even after cooling, because of its supercooled nature. Therefore, when the thermal transfer recording medium is stored in the form of a roll, the surface of a back layer (which is provided over a support included in the thermal transfer recording medium) is smeared, and thus stable formation of high-quality transferred images over a long period of time impossible.

BRIEF SUMMARY OF THE INVENTION

The present invention is aimed at solving the problems in related art and achieving the following object. An object of the present invention is to provide a thermal transfer recording medium capable of stably forming high-quality transferred images over a long period of time.

As a result of carrying out earnest examinations in light of the problems, the present inventors have found the following: when carnauba wax is used in the form of aqueous emulsion as a main component of the ink layer of the thermal transfer recording medium, use of a combination of an organic fatty acid having an acid value of 90 to 200 and at least one of a long-chain alcohol represented by Formula (1) and a long-chain alcohol represented by Formula (2), as an emulsifier for the carnauba wax, makes it possible to exhibit a function of suppressing blooming of the carnauba wax, in addition to a function as an emulsifier, and thus makes it possible to stably form high-quality transferred images over a long period of time.

Formula (1)

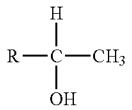

Formula (2)

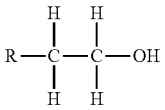

In Formulae (1) and (2), R denotes a group containing 28 to 38 carbon atoms.

The present invention is based upon the above-mentioned findings of the present inventors, and means for solving the problems are as follows.

<1> A thermal transfer recording medium including a support, a release layer and an ink layer, the release layer and the ink layer so being disposed in this order over the support, wherein the ink layer contains carnauba wax, an organic fatty acid having an acid value of 90 to 200, and at least one of a long-chain alcohol represented by Formula (1) and a long-chain alcohol represented by Formula (2), Formula (1)

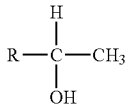

Formula (2)

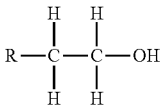

where R denotes a group containing 28 to 38 carbon atoms.

<2> The thermal transfer recording medium according to <1>, wherein the long-chain alcohol represented by Formula (1) has a melting point of 70° C. to 90° C. and the long-chain alcohol represented by Formula (2) has a melting point of 70° C. to 90° C.

<3> The thermal transfer recording medium according to <1> or <2>, wherein the organic fatty acid has an acid value of 140 to 200.

<4> The thermal transfer recording medium according to any one of <1> to <3>, wherein the amount of the organic fatty acid contained in the ink layer is in the range of 1 part by mass to 6 parts by mass per 100 parts by mass of the carnauba wax, and wherein the amount of the at least one of the long-chain alcohols, contained in the ink layer, is in the range of 6 parts by mass to 12 parts by mass per 100 parts by mass of the carnauba wax.

<5> The thermal transfer recording medium according to any one of <1> to <4>, wherein the ink layer further contains a nonionic surfactant.

<6> The thermal transfer recording medium according to <5>, wherein the amount of the nonionic surfactant contained in the ink layer is in the range of 2 parts by mass to 7 parts by mass per 100 parts by mass of the carnauba wax.

According to the present invention, it is possible to solve the problems in related art and provide a thermal transfer recording medium capable of stably forming high-quality transferred images over a long period of time.

DETAILED DESCRIPTION OF THE INVENTION

Thermal Transfer Recording Medium

A thermal transfer recording medium of the present invention includes a support, a release layer and an ink layer, the release layer and the ink layer being disposed in this order over the support. If necessary, the thermal transfer recording medium may further include other layer(s) suitably selected.

<Support>

The support is not particularly limited and may be suitably selected according to the purpose. Examples thereof include plastic films such as films of polyethylene terephthalate, polyesters, polycarbonates, polyimides, polyamides, polystyrene, polysulfones, polypropylene, polyethylene and cellulose acetate. Among these, films of polyethylene terephthalate are preferable in that they are superior in the strength, heat resistance and heat conductivity of the thermal transfer recording medium as a whole.

The thickness of the support is not particularly limited and may be suitably selected according to the purpose; however, it is preferably in the range of 3 μm to 10 μm.

<Release Layer>

The release layer has a function of improving separability between the support and the ink layer at the time of printing. When heated with a thermal head, the release layer thermally fuses and becomes a low-viscosity liquid, thereby facilitating the cutting off of the ink layer in the vicinity of the interface between the heated portion and the non-heated portion.

The release layer contains at least a wax and a binder resin. If necessary, the release layer may further include other component(s) suitably selected.

—Wax—

The wax is not particularly limited and may be suitably selected according to the purpose. Examples thereof include bees wax, whale wax, Japan wax, rice bran wax, carnauba wax, candelilla wax, montan wax, paraffin wax, polyethylene wax, oxidized polyethylene wax, acid-modified polyethylene wax, microcrystalline wax, acid wax, ozokerite, ceresin, ester wax, margaric acid, lauric acid, myristic acid, palmitic acid, stearic acid, furoic acid, behenic acid, lignoceric acid, montanic acid, stearyl alcohol, behenyl alcohol, sorbitan, stearic acid amide and oleic acid amide. Among these, carnauba wax and polyethylene wax are preferable in that they are relatively hard, superior in slickness, and highly effective in protecting transferred images when the transferred images are rubbed.

The binder resin is not particularly limited and may be suitably selected according to the purpose. Examples thereof include ethylene-vinyl acetate copolymer, partially saponified ethylene-vinyl acetate copolymer, ethylene-vinyl alcohol copolymer, ethylene-sodium methacrylate copolymer, polyamides, polyesters, polyurethanes, polyvinyl alcohol, methyl cellulose, carboxymethyl cellulose, starch, polyacrylic acid, isobutylene-maleic acid copolymer, styrene-maleic acid copolymer, polyacrylamide, polyvinyl acetal, polyvinyl chloride, polyvinylidene chloride, isoprene rubber, styrene-butadiene copolymer, ethylene-propylene copolymer, butyl rubber and acrylonitrile-butadiene copolymer. Among these, styrene-butadiene copolymer is preferable in that it is superior in transferability and adhesion to the support.

The thickness of the release layer is not particularly limited and may be suitably selected according to the purpose; however, it is preferably in the range of 0.5 μm to 2.0 μm.

<Ink Layer>

The ink layer contains carnauba wax, an organic fatty acid having an acid value of 90 to 200, and at least one of a long-chain alcohol represented by Formula (1) and a long-chain alcohol represented by Formula (2). Also, the ink layer preferably contains a colorant. If necessary, the ink layer may further contain a nonionic surfactant, a binder resin and other component(s) suitably selected.

Formula (1)

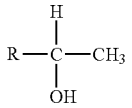

Formula (2)

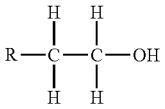

In Formulae (1) and (2), R denotes a group containing 28 to 38 carbon atoms.

—Carnauba Wax—

The inclusion of the carnauba wax in the ink layer yields superior rub resistance of the ink layer because the carnauba wax is a hard wax having a penetration of 1 or less. Also, since the carnauba wax has a low melting point of 80° C., it yields superior sensitivity characteristics. Further, since the carnauba wax has sharp heat-related changeability and a low melt viscosity, it yields superior printing characteristics.

The carnauba wax is contained in the ink layer, forming an emulsion together with the organic fatty acid having an acid value of 90 to 200 and the at least one of the long-chain alcohols represented by Formulae (1) and (2) above. In this case, when the emulsion is heated with a thermal head, cutting and resultant separation preferentially take place at boundaries between particles forming the emulsion. The cut and separated pieces are transferred to the surface of a transfer target object. Therefore, edges of transferred matter (printed matter) are very sharp, and, due to the aqueousness of the emulsion, there exists an advantage in that its environmental load can be reduced.

The method of forming the aqueous emulsion of the carnauba wax is not particularly limited and may be suitably selected according to the purpose. For example, the carnauba wax may be emulsified, using as an emulsifier a salt produced by adding the organic fatty acid and an organic base into liquid.

—Organic Fatty Acid—

The acid value of the organic fatty acid is not particularly limited as long as it is in the range of 90 to 200, and it may be suitably selected according to the purpose; however, it is preferably in the range of 140 to 200.

When the acid value is in the range of 90 to 200, the organic fatty acid has a high acid value and reacts with an alkali to form an anionic emulsifier, and it is possible to emulsify the carnauba wax without causing adverse effects on sensitivity and smear resistance.

When the acid value is less than 90, it may be impossible to emulsify the carnauba wax. When the acid value is greater than 200, it is possible to emulsify the carnauba wax but it may be impossible to use the emulsion as a coating solution because the emulsion is possibly in the form of cream.

Suitable examples of organic fatty acids having acid values in the above-mentioned range include oleic acid (acid value: 200) and behenic acid (acid value; 160).

The melting point of the organic fatty acid is preferably in the range of 70° C. to 90° C. When the melting point is in this range, it is close to the melting point of the carnauba wax, and thus favorable sensitivity characteristics can be obtained.

Suitable examples of organic fatty acids having melting points in the above-mentioned range include behenic acid (melting point: 76° C.).

When the melting point is lower than 70° C., printed images may be rubbed and smeared in a high-temperature environment, for example in summer. When the melting point is higher than 90° C., there may be degradation of sensitivity characteristics.

The amount of the organic fatty acid contained in the ink layer is not particularly limited and may be suitably selected according to the purpose; however, it is preferably in the range of 1 part by mass to 6 parts by mass per 100 parts by mass of the carnauba wax.

When the amount is less than 1 part by mass per 100 parts by mass of the carnauba wax, it may be impossible to emulsify the carnauba wax. When the amount is greater than 6 parts by mass per 100 parts by mass of the carnauba wax, blooming of the carnauba wax may occur.

—Long-Chain Alcohol Represented by Formula (1) or (2)—

The long-chain alcohol represented by Formula (1) below and the long-chain alcohol represented by Formula (2) below are not particularly limited and may be suitably selected according to the purpose; however, the number of carbon atoms contained in R in Formulae (1) and (2) below needs to be in the range of 28 to 38.

When the number of carbon atoms contained therein is less than 28 or greater than 38, blooming may not be suppressed.

Now, there exists the following phenomenon that is known to generally occur and is thus worth mentioning. The carnauba wax is first completely melted at the time of the formation of the aqueous emulsion, but blooming of the carnauba wax may occur at the ink layer surface as time passes, even after cooling, because of its supercooled nature. This presents a problem in that when the thermal transfer recording medium is stored in the form of a roll, the surface of a back layer is smeared. However, the use of at least one of the long-chain alcohols represented by Formulae (1) and (2) below, where the number of carbon atoms contained in R is in the range of 28 to 38, can yield an advantage in that the blooming of the carnauba wax can be suppressed.

Formula (1)

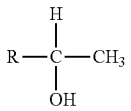

Formula (2)

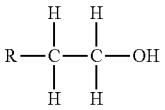

In Formulae (1) and (2), R denotes a group containing 28 to 38 carbon atoms.

The long-chain alcohols are not particularly limited and may be suitably selected according to the purpose; however, aliphatic alcohols are preferable.

Each long chain may be formed only of a straight chain or may have branched chain(s).

The melting points of the long-chain alcohols represented by Formulae (1) and (2) above are not particularly limited and may be suitably selected according to the purpose; however, they are preferably in the range of 70° C. to 90° C.

When the melting points are in the above-mentioned range, favorable sensitivity characteristics can be obtained because they are close to the melting point of the carnauba wax.

The amount of the at least one of the long-chain alcohols represented by Formulae (1) and (2) above, contained in the ink layer, is not particularly limited and may be suitably selected according to the purpose; however, it is preferably in the range of 6 parts by mass to 12 parts by mass per 100 parts by mass of the carnauba wax.

When the amount is less than 6 parts by mass per 100 parts by mass of the carnauba wax, blooming may not be suppressed. When the amount is greater than 12 parts by mass per 100 parts by mass of the carnauba wax, there may be an unfavorable difference in sensitivity between the at least one of the long-chain alcohols and the carnauba wax when there is a difference in melting point between the at least one of the long-chain alcohols and the carnauba wax.

—Organic Base—

The organic base is used together with the organic fatty acid when the carnauba wax is emulsified.

The organic base is not particularly limited and may be suitably selected according to the purpose; however, morpholine is suitable in that it easily volatilizes after dried.

The amount of the organic base contained in the ink layer is not particularly limited and may be suitably selected according to the purpose; however, the amount is preferably in the range of 0.5 parts by mass to 5 parts by mass per 100 parts by mass of the carnauba wax.

—Nonionic Surfactant—

Addition of the nonionic surfactant makes it possible to reduce the particle diameter of the aqueous emulsion of the carnauba wax and thus to improve cohesion of the ink layer and thereby prevent background smears.

The nonionic surfactant is not particularly limited and may be suitably selected according to the purpose; however, preference is given to POE oleyl ether.

The amount of the nonionic surfactant contained in the ink layer is not particularly limited and may be suitably selected according to the purpose; however, it is preferably in the range of 2 parts by mass to 7 parts by mass per 100 parts by mass of the carnauba wax.

When the amount is less than 2 parts by mass per 100 parts by mass of the carnauba wax, the particle diameter of the aqueous emulsion of the carnauba wax may not be effectively reduced. When the amount is greater than 7 parts by mass per 100 parts by mass of the carnauba wax, the ink layer softens, thereby possibly degrading rub resistance of images.

—Colorant—

The colorant is not particularly limited and may be suitably selected from colorants known in the art, according to the purpose. Examples thereof include carbon black, azo pigments, phthalocyanine, quinacridone, anthraquinone, perylene, quinophthalone, aniline black, titanium oxide, zinc oxide and chromium oxide. Among these, carbon black is preferable.

—Other Component(s)—

To the ink layer, any of the following may be added as a binder resin: acrylic resins, polyester resins, polyethylene, ethylene-vinyl acetate copolymer, ethylene-acrylate copolymer, urethane resins, cellulose resins, vinyl chloride-vinyl acetate copolymer, petroleum resins, rosin resins, derivatives of these, polyamides, and so forth.

The binder resin is preferably a binder resin superior in rub resistance, chemical resistance, etc. It should, however, be noted that the amount of heat applied by a conventional thermal transfer printer may not suffice to produce effects of the binder resin, and therefore the binder resin is preferably added so as not to hinder sensitivity.

Also, any of the following (besides the carnauba wax) may be added to the ink layer as a thermally fusible material: waxes and wax-like substances exemplified by paraffin wax, microcrystalline wax, oxidized paraffin wax, candelilla wax, montan wax, ceresin wax, polyethylene wax, oxidized polyethylene wax, castor wax, beef tallow hardened oil, lanolin, Japan wax, sorbitan stearate, sorbitan palmitate, stearyl alcohol, polyamide wax, oleyl amide, stearyl amide, hydroxystearic acid, synthetic ester wax and synthetic alloy wax.

The thickness of the ink layer is not particularly limited and may be suitably selected according to the purpose; however, it is preferably in the range of 1 μm to 3 μm.

<Other Layer(s)>

—Overlayer—

In the thermal transfer recording medium, an overlayer formed of a thermally fusible material may be provided on the ink layer to further enhance prevention of background smears. It should, however, be noted that when the overlayer is provided, the overall ink surface thickness increases, and therefore the overlayer is preferably used so as not to hinder heat from being efficiently applied to the ink layer by a thermal head.

Carnauba wax is preferable also as a thermally fusible material used as the material for the overlayer. This is because, as described above, carnauba wax is advantageous in that it yields superior rub resistance (because it is a hard wax having a penetration of 1), superior sensitivity characteristics (because it has a low melting point of 80° C.) and superior printing characteristics (because of its sharp heat-related changeability and low melt viscosity).

Also, in a manner similar to the above-mentioned addition to the ink layer, any of the following (besides the carnauba wax) may be added to the overlayer as a thermally fusible material: waxes and wax-like substances exemplified by paraffin wax, microcrystalline wax, oxidized paraffin wax, candelilla wax, montan wax, ceresin wax, polyethylene wax, oxidized polyethylene wax, castor wax, beef tallow hardened oil, lanolin, Japan wax, sorbitan stearate, sorbitan palmitate, stearyl alcohol, polyamide wax, oleyl amide, stearyl amide, hydroxy tearic acid, synthetic ester wax and synthetic alloy wax.

The thickness of the overlayer is not particularly limited and may be suitably selected according to the purpose; however, it is preferably in the range of 0.5 μm to 1.5 μm. —Back Layer—

In the thermal transfer recording medium of the present invention, a back layer is preferably provided over the surface of the support on the opposite side to the above-mentioned layers (over the surface of the support opposite to the surface of the support over which the ink layer is formed). At the time of transfer, heat is directly applied by means of a thermal head or the like to this surface on the opposite side correspondingly to an image, so that the back layer needs to have resistance to high heat and to rubbing against the thermal heat or the like.

Examples of materials suitable for the back layer include silicon-modified urethane resins, silicon-modified acrylic resins, silicone resins, silicone rubbers, fluorine resins, polyimide resins, epoxy resins, phenol resins, melamine resins and nitrocellulose.

Also, if necessary, inorganic fine particles such as fine particles of talc, silica and organopolysiloxane, a lubricant, etc. may be added to the back layer.

The thickness of the back layer is not particularly limited and may be suitably selected according to the purpose; however, it is preferably in the range of 0.01 μm to 1.0 μm.

The method for forming each of the above-mentioned layers is not particularly limited and may be suitably selected according to the purpose. For example, each layer may be formed by applying the material(s) over the support in accordance with a conventional coating method which uses a gravure coater, a wire bar coater, a roll coater or the like, and drying the material(s).

The transfer method with the thermal transfer recording medium of the present invention is not particularly limited and may be suitably selected according to the purpose. For example, an image can be transferred to a transfer target object by a method of heating and melting the release layer and the ink layer with a serial thermal head, a line thermal head or the like and thereby transferring an image.

The transfer target object is not particularly limited and may be suitably selected according to the purpose. Examples thereof include those known in the art, including commonly used films such as polyester films, polyolefin-based films, polyamide films and polystyrene films; commonly used papers such as synthetic paper, wash-resistant paper, lightweight coated paper, cast-coated paper and art paper; thick cards such as cards of PVC and PET, and thick paper; cloths and fabrics such as those made of nylons, polyesters, cotton, etc. and unwoven fabric; laminated films made by combining the above-mentioned films; and the above-mentioned films subjected to surface-treatments such as matte treatment, corona treatment, metal vapor deposition, etc.

EXAMPLES

The following explains the present invention more specifically, referring to Examples and Comparative Examples. It should, however, be noted that the present invention is not confined to these Examples.

Example 1

Production of Thermal Transfer Recording Medium

<Preparation of Coating Solution for Ink Layer>

One hundred parts by mass of carnauba wax, 2 parts by mass of montanic acid (acid value: 132, melting point: 80° C.) and 9 parts by mass of a long-chain alcohol (number of carbon atoms contained in R: 28 to 38, melting point: 75° C.) represented by Formula (1) above were dissolved at 120° C., then 5 parts by mass of morpholine was poured with agitation, and subsequently hot water of 90° C. was applied dropwise such that the solid content became 30% by mass, thereby forming an oil-in-water emulsion. Thereafter, the emulsion was cooled, and an aqueous emulsion of the carnauba wax, which had a solid content of 30% by mass, was thus obtained.

The average particle diameter of the obtained aqueous emulsion, measured using a laser diffraction scattering particle size distribution measuring apparatus (LA-920, manufactured by HORIBA, Ltd.), was 0.4 μm.

Subsequently, 80 parts by mass of the aqueous emulsion of the carnauba wax (solid content: 30% by mass) was mixed with 20 parts by mass of a carbon black aqueous dispersion (solid content: 30% by mass) so as to obtain a coating solution for an ink layer.

<Preparation of Coating Solution for Release Layer>

Fourteen parts by mass of a polyethylene wax (melting point: 99° C., penetration at 25° C.: 2), 6 parts by mass of a low-molecular-weight EVA (weight average molecular weight: 2,100, VAc: 21%), 60 parts by mass of toluene and 20 parts by mass of methyl ethyl ketone were dispersed until the average particle diameter became 2.5 μm, and a coating solution for a release layer was thus obtained.

<Preparation of Coating Solution for Back Layer>

By mixing together 16.8 parts by mass of a silicone rubber (solid content: 30% by mass), 0.2 parts by mass of a chloroplatinic acid catalyst and 83 parts by mass of toluene, a coating solution for a back layer was obtained.

The coating solution for a back layer was applied over one surface of a polyester film (4.5 μm in thickness) serving as the above-mentioned support, which was followed by drying at 80° C. for 10 seconds, and a back layer having a thickness of 0.02 μm was thus formed.

Then the coating solution for a release layer was applied over the surface of the polyester film on the opposite side to the surface of the polyester film over which the back layer was formed, then drying was carried out at 40° C. for 10 seconds, and a release layer having a thickness of 1.5 μm was thus formed.

Subsequently, the coating solution for an ink layer was applied over the release layer, which was followed by drying at 70° C. for 10 seconds, and an ink layer having a thickness of 1.7 μm was thus formed. In this way, a thermal transfer recording medium was obtained.

Examples 2 to 6 and Comparative Examples 1 to 7

Each thermal transfer recording medium was produced in the same manner as in Example 1 except that the composition of the ink layer was changed to the corresponding composition shown in Table 1. Also, the average particle diameters of the aqueous emulsions obtained were measured using a laser diffraction scattering particle size distribution measuring apparatus (LA-920, manufactured by HORIBA, Ltd.).

It should be noted that, regarding Comparative Examples 2 and 4, it was impossible to form an aqueous emulsion of carnauba wax and thus impossible to obtain a thermal transfer recording medium.

The following shows details of the long-chain alcohols used in Examples and Comparative Examples.

Examples 1 to 4, and 6; and Comparative Examples 2 and 4

Structure: Formula (1) above

Number of carbon atoms contained in R: 28 to 38

Melting point: 75° C.

Name of product: NPS-9210 (manufactured by NIPPON SEIRO CO., LTD.)

Example 5

Structure: Formula (2) above

Number of carbon atoms contained in R: 30

Melting point: 87° C.

Name of product: 1-triacontanol (manufactured by TOKYO CHEMICAL INDUSTRY CO., LTD.)

Comparative Example 3

Structure: Formula (2) above

Number of carbon atoms contained in R: 22

Melting point: 70° C.

Name of product: 1-docosanol (manufactured by TOKYO CHEMICAL INDUSTRY CO., LTD.)

Comparative Examples 5 and 6

Structure: Formula (1) above

Number of carbon atoms contained in R: 35 to 46

Melting point: 93° C.

Production method: 4 parts by mass of boric acid was added to 400 parts by mass of a long-chain hydrocarbon containing 35 to 46 carbon atoms, which was followed by air oxidation at 160° C. and then hydrolysis, and a long-chain alcohol (melting point: 93° C.) represented by Formula (1) above was thus obtained.

Comparative Example 7

Structure: Formula (1) above

Number of carbon atoms contained in R: 18 to 38

Melting point: 72° C.

Production method: 4 parts by mass of boric acid was added to 400 parts by mass of a long-chain hydrocarbon containing 18 to 38 carbon atoms, which was followed by air oxidation at 160° C. and then hydrolysis, and a long-chain alcohol (melting point: 72° C.) represented by Formula (1) above was thus obtained.

TABLE 1

| | Components | | | | | | | Amount (parts by mass) (per 100 parts by mass of carnauba wax) | | | Average particle diameter of emulsion (μm) |
|---|---|---|---|---|---|---|---|---|---|---|---|
| | Organic fatty acid | | | Long-chain alcohol | | | | | | | |
| | Type | Acid value | Melting point | Structure | Number of carbon atoms contained in R | Melting point | Nonionic surfactant | Organic-fatty acid | Long-chain alcohol | Nonionic surfactant | |
| Ex. 1 | Montanic acid | 132 | 80 | Formula (1) | 28 to 38 | 75 | — | 2 | 9 | — | 0.4 |
| Ex. 2 | C24 synthetic fatty acid | 115 | 89 | Formula (1) | 28 to 38 | 75 | — | 2 | 9 | — | 0.4 |
| Ex. 3 | Oleic acid | 200 | 12 | Formula (1) | 28 to 38 | 75 | — | 2 | 9 | — | 0.3 |
| Ex. 4 | Behenic acid | 160 | 76 | Formula (1) | 28 to 38 | 75 | — | 2 | 6 | — | 0.3 |
| Ex. 5 | Behenic acid | 160 | 76 | Formula (2) | 30 | 87 | — | 2 | 9 | — | 0.3 |

TABLE 1-continued

| | Components | | | | | | | Amount (parts by mass) (per 100 parts by mass of carnauba wax) | | | Average particle diameter of emulsion (μm) |
|---|---|---|---|---|---|---|---|---|---|---|---|
| | Organic fatty acid | | | Long-chain alcohol | | | | | | | |
| | Type | Acid value | Melting point | Structure | Number of carbon atoms contained in R | Melting point | Nonionic surfactant | Organic-fatty acid | Long-chain alcohol | Nonionic surfactant | |
| Ex. 6 | Behenic acid | 160 | 76 | Formula (1) | 28 to 38 | 75 | POE oleyl ether | 2 | 6 | 5 | 0.2 |
| Comp. Ex. 1 | Oleic acid | 200 | 12 | | — | | | 2 | — | — | 0.4 |
| Comp. Ex. 2 | | — | | Formula (1) | 28 to 38 | 75 | — | — | 9 | — | Impossible to emulsify |
| Comp. Ex. 3 | Oleic acid | 200 | 12 | Formula (2) | 22 | 70 | — | 2 | 9 | — | 0.4 |
| Comp. Ex. 4 | Palmitic acid | 219 | 63 | Formula (1) | 28 to 38 | 75 | — | 2 | 9 | — | Produced in the form of cream |
| Comp. Ex. 5 | Oleic acid | 200 | 12 | Formula (1) | 35 to 46 | 93 | — | 2 | 9 | — | 0.4 |
| Comp. Ex. 6 | Behenic acid | 160 | 76 | Formula (1) | 35 to 46 | 93 | — | 2 | 9 | — | 0.4 |
| Comp. Ex. 7 | Behenic acid | 160 | 76 | Formula (1) | 18 to 38 | 72 | — | 2 | 9 | — | 0.4 |

Regarding Examples 1 to 6 and Comparative Examples 1 to 7, the emulsifiability at the time of the formation of each aqueous emulsion was evaluated.

Also, regarding the thermal transfer recording media of Examples 1 to 6 and Comparative Examples 1, 3 and 5 to 7, the temporal stability of image quality, the sensitivity suitability (resolution), the rub resistance of images, and background smears were evaluated. The results are shown in Table 2.

[Emulsifiability]

The emulsifiability was evaluated in accordance with the following criteria, based upon the average particle diameter of each aqueous emulsion obtained.

—Evaluation Criteria—

A: 0.3 μm or less

B: 0.4 μm to 0.5 μm

C: 0.6 μm or greater

D: Impossible to emulsify

[Temporal Stability of Image Quality]

Each thermal transfer recording medium (thermal transfer sheet), which measured 80 mm (width)×200 m, was wound into the form of a roll and then stored at 40° C. for 3 months. Using the thermal transfer recording medium (thermal transfer sheet roll) which had been stored, printing was continuously performed onto 500 sheets under the following conditions, and images and a thermal head were evaluated in accordance with the following criteria.

Printer: Thermal transfer printer (M4800RV, manufactured by SATO CORPORATION)

Head density: 8 dots/inch (head, manufactured by TEM Corporation)

Printing speed: 8 inches/sec.

Printing energy: Memory 2

Transfer target object: cast-coated paper, manufactured by SATO CORPORATION

Printing pattern: 1 dot letter (The term "1 dot letter" means a letter formed by one dot (i.e. one resistor) of a thermal head.)

—Evaluation Criteria—

A: There was no adhesion of waste matter to the thermal head, and there was no blurring in the image printed on the 500th time.

B: There was slight adhesion of waste matter to the thermal head, but there was no blurring in the image printed on the 500th time.

C: There was adhesion of waste matter to the thermal head, and there was blurring in the image printed on the 500th time.

D: There was adhesion of a large amount of waste matter to the thermal head, and there was blurring in the image printed on the 100th time.

[Sensitivity Suitability (Resolution)]

Printing with each thermal transfer recording medium was carried out under the following conditions, and the resolution of horizontal bars formed was evaluated in accordance with the following criteria.

Printer: Thermal transfer printer (M4800RV, manufactured by SATO CORPORATION)

Head density: 8 dots/inch (head, manufactured by TDK Corporation)

Printing speed: 8 inches/sec.

Printing energy: Memory 2

Transfer target object: cast-coated paper, manufactured by SATO CORPORATION

Printing pattern: 1 dot letter (The term "1 dot letter" means a letter formed by one dot (i.e. one resistor) of a thermal head.)

—Evaluation Criteria—

A: There was no blurring, no loss or no deformation, and the horizontal bars were recognizable.

B: There was slight blurring, loss or deformation, but the horizontal bars were recognizable.

C: There was blurring, loss or deformation, and the horizontal bars were unrecognizable.

D: Transferred images cannot be obtained.

[Rub Resistance of Image]

At 40° C., using a rub tester, cardboard was rubbed back and forth 100 times against a transferred image at a pressure of 80 g/cm$^2$, and the extent of damage done to the image was visually observed and evaluated in accordance with the following criteria.

—Evaluation Criteria—

A: The image was not at all damaged.

B: The image was almost not damaged.

C: The image was somewhat damaged.

D: The image was completely damaged.

[Background Smear]

Printing with each thermal transfer recording medium was carried out under the following conditions, and background smears were evaluated in accordance with the following criteria.

Printer: Thermal transfer printer (M4800RV, manufactured by SATO CORPORATION)

Head density: 8 dots/inch (head, manufactured by TDK Corporation)

Printing speed: 8 inches/sec.

Printing energy: Memory 2

Transfer target object: YUPO SGU (manufactured by Oji-Yuka Synthetic Paper Company)

Printing pattern: 1 dot letter (The term "1 dot letter" means a letter formed by one dot (i.e. one resistor) of a thermal head.)

—Evaluation Criteria—

A: There were no rub-related smears other than in a printed portion.

B: There were slight rub-related smears other than in a printed portion.

C: There were rub-related smears other than in a printed portion.

D: There were rub-related smears all over.

TABLE 2

| | Emulsifiability | Temporal stability of image quality | Sensitivity suitability (Resolution) | Rub resistance of image | Background smear |
|---|---|---|---|---|---|
| Ex. 1 | B | A | A | A | B |
| Ex. 2 | B | A | A | A | B |
| Ex. 3 | A | A | B | B | B |
| Ex. 4 | A | A | A | A | B |
| Ex. 5 | A | A | A | A | B |
| Ex. 6 | A | A | A | A | A |
| Comp. Ex. 1 | B | D | B | B | B |
| Comp. Ex. 2 | D | | Impossible to evaluate | | |
| Comp. Ex. 3 | B | D | B | B | B |
| Comp. Ex. 4 | D | | Impossible to evaluate | | |
| Comp. Ex. 5 | B | C | B | B | B |
| Comp. Ex. 6 | B | C | B | A | B |
| Comp. Ex. 7 | B | C | A | A | B |

Table 2 demonstrates that the thermal transfer recording media of Examples 1 to 6 made it possible to stably form high-quality transferred images over a long period of time.

It has been proved that Examples 3 to 5, in particular, where the organic fatty acids each having an acid value of 140 to 200 were used, were superior in emulsifiability, which made it possible to form emulsions of small particle diameters, and also superior in temporal stability of image quality.

Also, it has been proved that, in Example 6 where the nonionic surfactant was added, layer cohesion was improved by the reduction in the particle diameter of the emulsion, and the occurrence of background smears could be prevented.

Since a thermal transfer recording medium of the present invention is capable of stably forming high-quality transferred images over a long period of time, the thermal transfer recording medium can be suitably used in a variety of thermal transfer recording apparatuses such as thermal transfer printers.

What is claimed is:

1. A thermal transfer recording medium comprising:

a support;

a release layer; and an ink layer, the release layer and the ink layer being disposed in this order over the support, wherein the ink layer contains carnauba wax, an organic fatty acid having an acid value of 90 to 200, and at least one of a long-chain alcohol represented by Formula (1) and a long-chain alcohol represented by Formula (2), Formula (1)

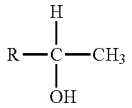

Formula (2)

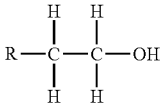

where R denotes a group containing 28 to 38 carbon atoms.

2. The thermal transfer recording medium according to claim 1, wherein the long-chain alcohol represented by Formula (1) has a melting point of 70° C. to 90° C. and the long-chain alcohol represented by Formula (2) has a melting point of 70° C. to 90° C.

3. The thermal transfer recording medium according to claim 1, wherein the organic fatty acid has an acid value of 140 to 200.

4. The thermal transfer recording medium according to claim 1, wherein the amount of the organic fatty acid contained in the ink layer is in the range of 1 part by mass to 6 parts by mass per 100 parts by mass of the carnauba wax, and wherein the amount of the at least one of the long-chain alcohols, contained in the ink layer, is in the range of 6 parts by mass to 12 parts by mass per 100 parts by mass of the carnauba wax.

5. The thermal transfer recording medium according to claim 1, wherein the ink layer further contains a nonionic surfactant.

6. The thermal transfer recording medium according to claim 5, wherein the amount of the nonionic surfactant contained in the ink layer is in the range of 2 parts by mass to 7 parts by mass per 100 parts by mass of the carnauba wax.

* * * * *